US007484969B2

(12) United States Patent
Shiu

(10) Patent No.: US 7,484,969 B2
(45) Date of Patent: Feb. 3, 2009

(54) ELECTRICAL CONNECTOR ASSEMBLY

(75) Inventor: Guo-Jiun Shiu, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/001,555

(22) Filed: Dec. 11, 2007

(65) Prior Publication Data

US 2008/0139019 A1 Jun. 12, 2008

(30) Foreign Application Priority Data

Dec. 11, 2006 (TW) ..... 95221786 U

(51) Int. Cl.
*H01R 12/00* (2006.01)

(52) U.S. Cl. ..... 439/74; 439/660

(58) Field of Classification Search ..... 439/74, 439/660

See application file for complete search history.

(56) References Cited

U.S. PATENT DOCUMENTS

| | | | | |
|---|---|---|---|---|
| 5,116,247 | A | 5/1992 | Enomoto et al. | |
| 5,888,077 | A | 3/1999 | Champion et al. | |
| 6,132,258 | A * | 10/2000 | Kajinuma | 439/660 |
| 6,902,411 | B2 * | 6/2005 | Kubo | 439/74 |
| 7,128,581 | B2 * | 10/2006 | Igarashi et al. | 439/74 |

* cited by examiner

*Primary Examiner*—Tho D Ta
*Assistant Examiner*—Travis Chambers
(74) *Attorney, Agent, or Firm*—Wei Te Chung

(57) ABSTRACT

An electrical connector assembly comprises a first connector having a first housing and a first retainer and a second connector having a second housing and a second retainer. The first retainer and the second retainer respectively retained on two opposed end of the first housing and the second housing. The second retainer is in an M-shaped and assembles to the second housing from a top surface of the second housing. The second retainer has two contacting arms for engaging with the first retainer.

15 Claims, 5 Drawing Sheets

ELECTRICAL CONNECTOR ASSEMBLY

BACKGROUND OF THE INVENTION

1. Field of the Invention

The present invention relates to a board to board connector assembly.

2. Description of Related Art

A board to board connector is used to electrically link two print circuit boards to transmit electrical signals. Such a board to board connector usually has a pair of retainer members respectively assembled on opposed ends thereof, the retainer member has a soldering portion for being soldered to a print circuit board to reliably mount the board to board connector to the print circuit board.

U.S. Pat. No. 6,645,005 discloses a board-to-board connector assembly having a plug connector and a receptacle connector, both the plug and the receptacle connectors have a pair of retainer members on opposed ends thereof for being soldered to a print circuit board, respectively, and each retainer member has a mating portion with a clasping portion. When the plug connector mates with the receptacle connector, the retainers of the plug connector engage with the retainers of the receptacle connector in manner of the clasping portions of corresponding mating portions clasping with each other to enhance a mating force between this mating process and prevent the plug connector easily falling from the receptacle connector. However, the retainers are respectively disposed out of two lateral ends of the plug connector and the receptacle connector, so during the plug connector mating with the receptacle connector, the mating portions of the retainers may distort along a longitudinal direction, which will influence an interferential force between the engaging retainers, and insulting housings of the connector assembly may be damaged by the retainers if user inserts the first connector by unbalanced force.

Hence, an improved connector assembly is required to overcome the disadvantages of the prior art.

SUMMARY OF THE INVENTION

An object of the present invention is to provide a connector assembly with retainers which can enhance mating force.

Accordingly, to achieve above-mentioned object, an electrical connector assembly comprises a first connector and a second connector, the first connector has a first housing defining a receiving portion, a plurality of first contacts received in the first housing and a first retainer assembled to the first housing and formed with an elastic contacting arm exposed in the receiving portion; the second connector has a second housing, a plurality of second contacts received in the second housing and a second retainer assembled to the second housing from a top surface of the second housing. The second retainer has a horizontal shoulder portion, two contacting arms downwardly extending from opposed ends of the horizontal shoulder portion to be disposed on side faces of the second housing to engage with the elastic contacting arms of the first retainer and two tails respectively extending outwardly from an end of the contacting arm away from the horizontal shoulder portion.

Other objects, advantages and novel features of the present invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
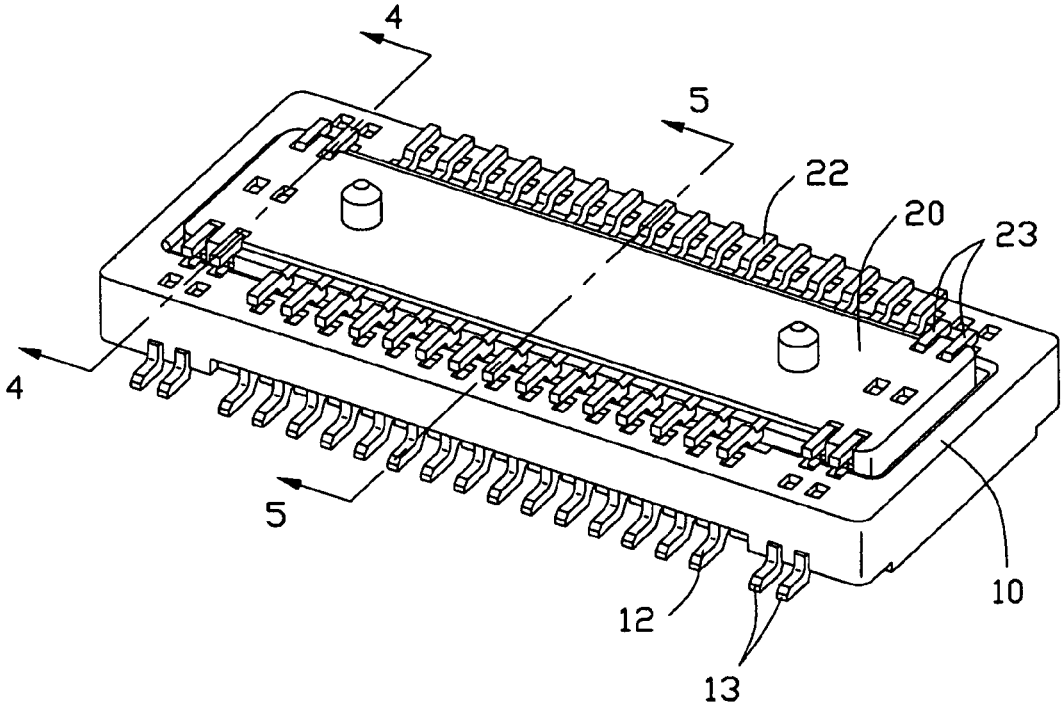
FIG. 1 is a perspective, assembled view of an electrical connector assembly of the present invention.

Referring to FIG. 1, the electrical connector assembly comprise a first connector 10 and a second connector 20 respectively mounted to a print circuit board (not shown).

Figure 2:
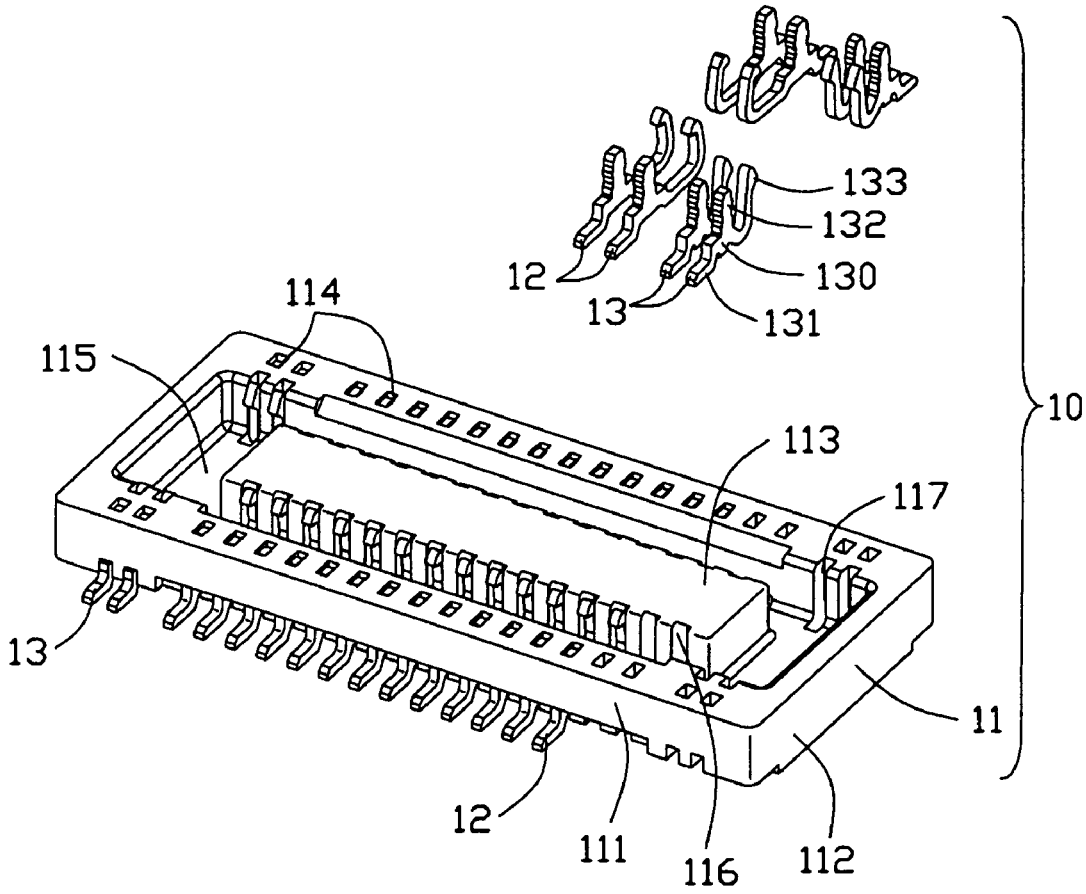
FIG. 2 is a partially exploded, perspective view of a first connector of the electrical connector assembly of the present invention.
Figure 5:
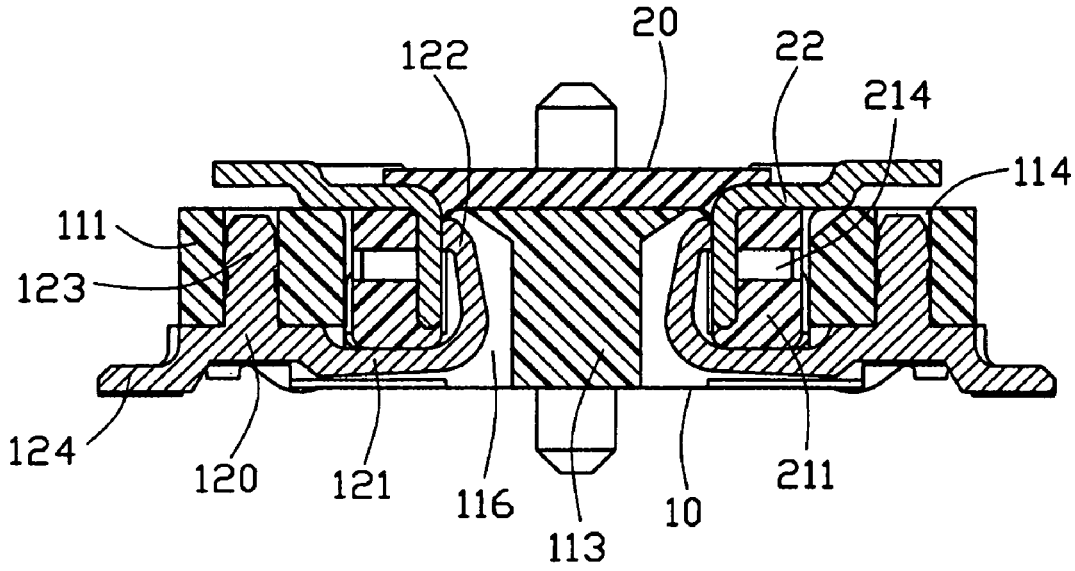
FIG. 5 is cross sectional view of the electrical connector assembly, taken from line 5-5.

Referring to FIGS. 2 and 5, the first connector 10 comprises a first housing 11, a plurality of first contacts 12 received in the first housing 11 and a pair of first retainers 13 assembled on two opposed lateral ends of the first housing 11. The first housing 11 is a longitudinal insulating housing and has a peripheral wall (not labeled), which comprises a pair of longitudinal sidewalls 111 and a pair of transverse end walls 112. Each sidewall 111 defines a plurality of holes 114 passing through a top and a bottom surfaces thereof and a plurality of first slots 117 near the two opposed ends of the first housing 11. The first housing 1 is formed with a mating portion 113 extending from bottom of the first housing 11 and disposed in a center of the peripheral wall. The mating portion 113 defines a plurality of first contact channels 116 for the first contacts 12 on side surface thereof. The mating portion 113 and the peripheral wall define a receiving portion 115 therebetween, which communicates with the first contact channels 116.

The first contact 12 is received in the first housing 11 and comprises a main body 120, a linking arm 121 extending from the main body 120 and into the receiving portion 115 of the first housing 11, a mating arm 122 extending from an end of the linking portion 121, a fixing portion 123 upwardly extending from the main body 120 and a soldering portion 124 extending from the main body 120 and beyond the first housing 11. The first contact 12 inserts into the first housing 11 from a bottom face of the first housing 11. The main body 120 and the linking arm 121 extend in a horizontal direction and both are placed below the first housing 11. The linking arm 121 links the main body 120 and the mating arm 122, the mating arm 122 is received into the first contact channel 116, a free end of the mating arm 122 protrudes into the receiving portion 115 to abut against corresponding second contact 22 of the second connector 20. The fixing portion 123 inserts into the hole 114 of the sidewall 111 to retain the first contact 12 to the first housing 11. The soldering portion 124 extends beyond the first housing 11 and is soldered to the print circuit board (not shown).

Figure 4:
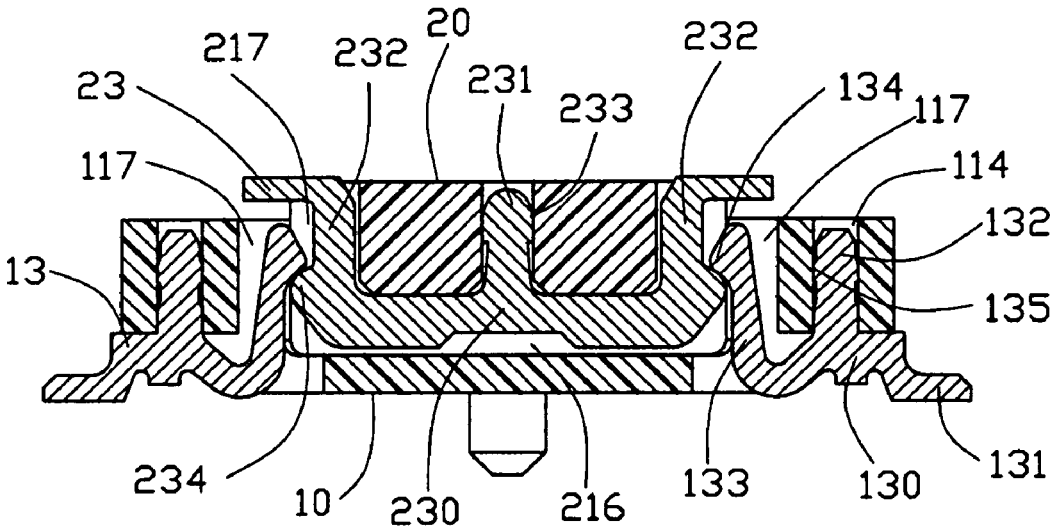
FIG. 4 is cross sectional view of the electrical connector assembly, taken from line 4-4.

Conjoint with the FIG. 4, the first retainer 13 is received in the first slot 117 of the first housing 11 and comprises a base portion 130, a tail 131 extending from the base portion 130 and beyond the first housing 11, a retaining portion 132 extending upwardly from the base portion 130 and received into the holes 114 and an elastic contacting arm 133 extending from the base portion 130 and toward the receiving portion 115. The base portion 130 is placed below the sidewall 111, and the tails 131 of the first retainers 13 are aligned with the soldering portions 124 of the first contacts 12. The retaining portion 132 has tabs 135 on sides thereof to engage with inner sidewall of the holes 114. The elastic contacting 133 has an elastic end with a contacting heave 134, which is referred as first latching portion and is exposed in the receiving portion 115 of the first housing 11. The first retainer 13 is in a similar figure with the first contact 12, referring to FIG. 2, the only difference between the first retainer 13 and the first contact 12 is that the elastic contacting arm 133 of the first retainer 13 is received in the sidewall 111, but the mating arm 122 of the first contact 12 extends into the receiving portion 115 and is received in the first contact channel 116 of the mating portion 113.

Figure 3:
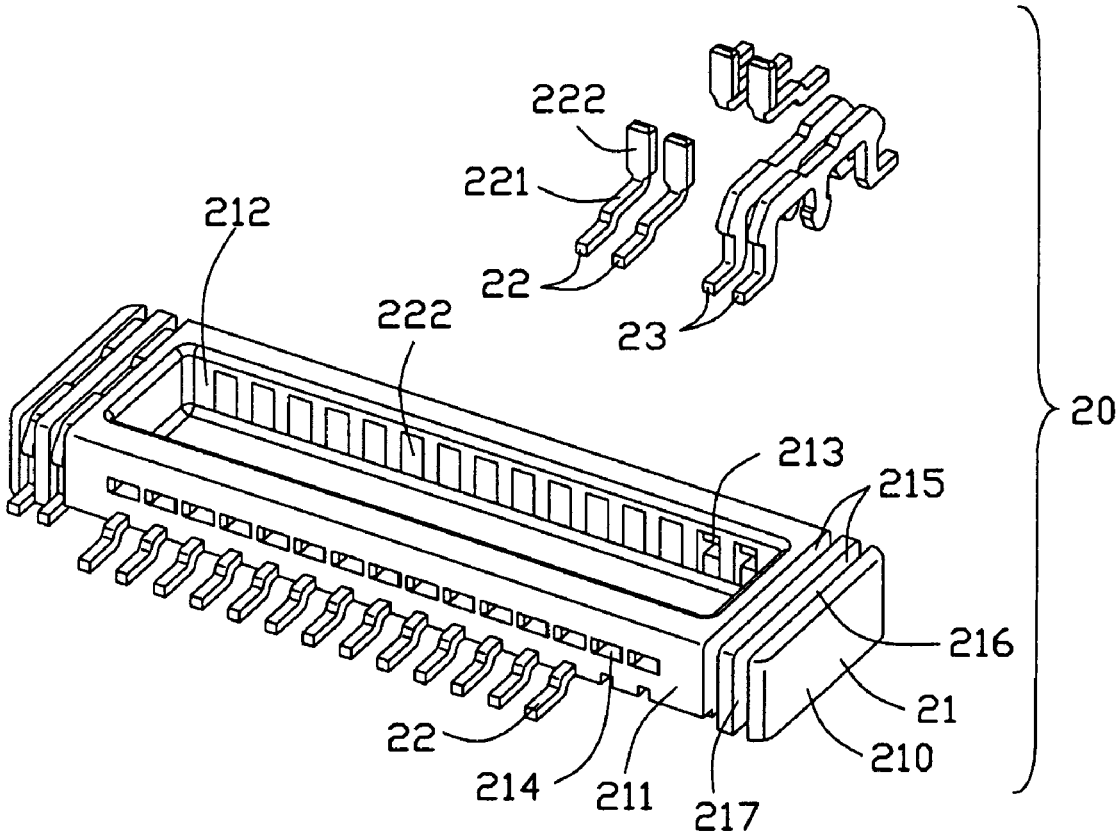
FIG. 3 is a partially exploded, perspective view of a second connector of the electrical connector assembly of the present invention.

Referring to FIGS. 3 and 5, the second connector 20 has a second housing 21, a plurality of second contacts 22 received in the second housing 21, and a pair of second retainers 23 assembled on two opposed ends of the second housing 11. The second housing 21 is a longitudinal insulating housing and comprises opposed end walls 210, opposed sidewalls 211 and a receiving space 212 defined by the end walls 210 and the sidewalls 211. The sidewall 211 defines a plurality of second contact channels 213 on an inner surface thereof along a longitudinal direction, and a plurality of through holes 214 through the inner and an outside surfaces thereof. The end wall 210 of the second housing 21 defines a plurality of second slots 215 for the second retainers 23. The second slot 215 comprises a horizontal slot 216 recessed on an top surface of the end wall 210 and bestriding the end wall 210, and two vertical slots 217 recessed on two side faces of the end wall 213.

The second contact 22 is in an L-shaped and comprises a horizontal portion 221 and an upright portion 222, the horizontal portion 221 extend beyond the second housing 21 from a bottom of the sidewall 211 to form a soldering portion for being soldered to the print circuit board (not shown). The upright portion 222 is wider than the horizontal portion 221 and is received in the second contact channels 213 of the sidewall 211 for contacting with the mating arm 122 of the first contact 12.

Referring to FIG. 4, the second retainer 23 is in a M-shaped and comprises a horizontal shoulder portion 230, an engaging portion 231 vertical extending from a middle part of the horizontal shoulder portion 230, two contacting arms 232 vertical extending from opposed ends of the horizontal shoulder portion 23 and two tails (not labeled) extending outwardly from ends of the contacting arms 232 away from the horizontal shoulder portion 230. The horizontal shoulder portion 230 is received in the horizontal slot 216 of the end wall 210, the engaging portion 231 is retained in the second housing 21 by tabs 233 formed on sides thereof, the contacting arms 232 are received in the vertical slots 217. The contacting arm 232 has a protuberance 234 which is referred as a second latching portion for engaging with the contacting heave 134 of the first retainer 13, the tail of the contacting arm 232 horizontal extends beyond the second housing 20.

When the first connector 10 mates with the second connector 20, the mating portion 113 of the first connector 10 inserts into the receiving space 212 of the second connector 20, the opposed sidewalls 211 and the end walls 210 of the second connector 20 are received in the receiving portion 115 of the first connector 10, the first contacts 12 electrical contact with the second contacts 22. The first retainer 13 contacts corresponding second retainer 23 by the contacting heave 134 of the elastic contacting arm 133 latching with the protuberance 234 of the contacting arm 232 to enhance a mating force during a mating process. So the first and the second retainers 13, 23 can respectively mount the first connector 10 and the second connector 20 to corresponding print circuit boards and establish a reliably engagement between the first connector 10 and the second connector 20.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly comprising:

a first connector having a first housing defining a receiving portion, a plurality of first contacts received in the first housing and a pair of first retainers assembled to the first housing, the first retainer being formed with an elastic contacting arm exposed in the receiving portion;

a second connector having a second housing, a plurality of second contacts received in the second housing and a second retainer assembled to the second housing from a top surface of the second housing, the second retainer having a horizontal shoulder portion, two contacting arms downwardly extending from opposed ends of the horizontal shoulder portion and being disposed on side faces of the second housing to engage with the elastic contacting arms of the first retainers and two tails respectively extending outwardly from bottom ends of the contacting arms, the bottom end being away from the horizontal shoulder portion in a top to bottom direction; wherein the end wall of the second connector defines a plurality of slots, the slot comprises a horizontal slot on a top surface of the end wall to receive the horizontal shoulder portion of the second retainer and two vertical slots on two side faces of the end wall to receive the two contacting portions of the second retainer.

2. The electrical connector assembly as described in claim 1, wherein the second retainer has an engaging portion downwardly extending from a middle part of the horizontal shoulder portion to insert into the second housing.

3. The electrical connector assembly as described in claim 2, wherein the tails of the second retainer are soldered to a print circuit board for the second connector.

4. The electrical connector assembly as described in claim 1, wherein the first housing has two opposed sidewalls, two opposed end walls and a mating portion, the receiving portion is defined by the sidewalls and the end walls and surrounds the mating portion, the first retainers are retained to the end wall.

5. The electrical connector assembly as described in claim 4, wherein the second housing has two opposed sidewalls, two opposed end walls and a receiving space defined by the sidewalls and the end walls to receive the mating portion of the first connector, the second retainer is assembled on the end wall of the second housing.

6. The electrical connector assembly as described in claim 5, wherein the first retainer has a base portion, a retaining portion vertically extending from the base portion and retained in the first housing, the elastic contacting arm extending from the base portion and toward the receiving portion and a tail extending beyond the second housing.

7. The electrical connector assembly as described in claim 6, wherein each of the first contacts and the second contacts has a soldering portion, the tails of the first retainers are disposed in same sides of the first housing with the soldering portions of the first contacts, the tails of the second retainer are disposed in same sides of the second housing with the soldering portions of the second contacts.

8. The electrical connector assembly as described in claim 7, wherein the first contact has a similar figure with the first retainer.

9. An electrical connector comprising:

a longitudinal housing;

a plurality of contacts received in the housing; and a pair of retainers assembled to two opposed ends of the housing from a top surface of the housing, each retainer having a horizontal shoulder portion assembled on the top surface of the housing, two contacting arms downwardly extending from opposed ends of the horizontal shoulder portion and being disposed on side faces of the housing and two tails respectively extending outwardly from bottom ends of the contacting arms adjacent to a bottom surface of the housing which is opposed to the top surface; wherein the end wall defines a plurality of slots, the slot comprises a horizontal slot on a top surface of the end wall to receive the horizontal shoulder portion of the retainer and two vertical slots on two side faces of the end wall to receive the two contacting portions of the retainer.

10. The electrical connector as described in claim 9, wherein the retainer has an engaging portion downwardly extending from a middle part of the horizontal shoulder portion to insert into the housing.

11. The electrical connector as described in claim 10, wherein the tails of the retainers are soldered to a print circuit board for the electrical connector.

12. The electrical connector as described in claim 11, wherein the housing has two opposed sidewalls, two opposed end walls and a receiving space defined by the sidewalls and the end walls, the retainers are assembled on the end walls.

13. The electrical connector as described in claim 12, wherein each contacts has a soldering portion, the tails of the retainers are disposed in same sides of the housing with the soldering portions of the contacts.

14. An electrical connector assembly comprising:

a first connector defining a first insulative housing with a plurality of first contacts therein;

a second connector defining a second insulative housing with a plurality of second contacts therein;

the first connector including a center island in a receiving cavity formed by a pair of first side walls and a pair of first end walls;

the second connector including a center receiving space to receive said center island, and a pair of second side walls and a pair of second end walls commonly defining said center receiving space and commonly received in said receiving cavity;

said first connector including a pair of first retainers on the corresponding first side walls proximate the corresponding first end wall, and said second connector including a second retainer on the corresponding second end wall engaged with said pair of first retainers; wherein said pair of first retainers are discrete from each other and each first retainer has a respective retention onion to independently and individually secure each first retainer to the first housing; wherein the second retainer defines a M-shaped configuration with two side contacting arms linked by a shoulder portion under condition that the shoulder portion directly confronts intimately the first housing.

15. The electrical connector assembly as claimed in claim 14, wherein the second retainer further includes an engaging portion between said two side contacting arms to secure the second retainer to the second housing.

* * * * *